US005772428A

United States Patent [19]

Van Den Sype et al.

[11] Patent Number: 5,772,428

[45] Date of Patent: Jun. 30, 1998

[54] METHOD AND APPARATUS FOR HEAT TREATMENT INCLUDING $H_2/H_2O$ FURNACE REGION CONTROL

[75] Inventors: Jaak Stefaan Van Den Sype, Scarsdale; Richard Bruce Vankempema, Hopewell Junction, both of N.Y.

[73] Assignee: Praxair Technology, Inc., Danbury, Conn.

[21] Appl. No.: 599,204

[22] Filed: Feb. 9, 1996

[51] Int. Cl.[6] ..... F27B 9/04; F27D 7/00

[52] U.S. Cl. ..... 432/23; 432/200; 148/634

[58] Field of Search ..... 432/18–23, 198–200; 148/625, 629, 633–634

[56] References Cited

U.S. PATENT DOCUMENTS 5,211,820 5/1993 Poor et al. ..... 204/153.18

FOREIGN PATENT DOCUMENTS 56-013430 2/1981 Japan .
56-102518 8/1981 Japan .
56-107155 8/1981 Japan .
05164727 6/1993 Japan .

OTHER PUBLICATIONS

Armson, F.J.; Barnett, J.H.; Davies, D.W.L. "Electrochemical Sensors for Heat Treatment Atmosphere Monitoring"; Met –Slag–Gas React. Processes, [Pap.Int.Symp.], (1975), pp. 905–918.

Sastri P. and Abraham K.P., "Atmosphere Control in Heat Treatment Furnaces Using Oxygen Probes", Tool And Alloy Steels, Apr.–May 1986, pp. 155–162.

Chen Y.C., "Automatic Control of Carbon Potential in Furnace Atmospheres Without Adding Enriched Gas", Metallurgical Transactions B, 24B, Oct. 1993, pp. 881–888.

Weissohn, K.H. "Sauerstoffmesszellen zum Regeln von Ofenatmospharen" Gaswarme International, 32, 436–437, 1983.

Weissohn, K.H., "Oxygen Partial Pressure Measurements With a Zirconium Oxide Probe", Gas Warme International, 29, 331–342, 1980.

*Primary Examiner*—William Doerrler
*Attorney, Agent, or Firm*—Bernard Lau

[57] ABSTRACT

A closed-loop control system controls introduction of either water or hydrogen into a furnace region where a part is subjected to an elevated temperature to accomplish a heat treatment process. The heat treatment process causes the part to participate in reduction and/or oxidation reactions which remain in balance at the elevated temperature so long as a hydrogen/water ratio set point is maintained. The system includes an oxygen probe in communication with the furnace region for providing (i) an oxygen output indicative of sensed oxygen concentration within furnace region, and (ii) a temperature output indicative of temperature therein. A controller determines from the oxygen output and temperature output, a measured ratio of hydrogen to water within the furnace region and compares the measured ratio with the hydrogen/water ratio set point, and provides a correction signal output in accordance with a determined difference between the measured ratio and the ratio set point. A flow controller is responsive to the correction signal output to provide a flow of at least one of hydrogen and water to the furnace region to move the hydrogen/water ratio towards said ratio set point.

12 Claims, 4 Drawing Sheets

■ % HYDROGEN
◆ % WATER

METHOD AND APPARATUS FOR HEAT TREATMENT INCLUDING $H_2/H_2O$ FURNACE REGION CONTROL

FIELD OF THE INVENTION

This invention relates to heat treatment processes and, more particularly, to a heat treatment process wherein a reaction occurs whose balance is controlled by an $H_2/H_2O$ ratio and a method and apparatus for maintaining that balance.

BACKGROUND OF THE ART

In many heat treating processes, the role of the surrounding atmosphere is to obtain a desired surface condition and/or to eliminate impurities or processing aids in the materials to be treated. To achieve this goal, it is necessary to control the oxidation-reduction reactions for the chemical elements present in parts being processed.

Such processes include steel decarburization, annealing, bright annealing for steel strip, iron powder reduction, debinding and sintering of ceramic and metal powders, etc. $H_2$ is the most often used active gas in these applications and oxidation-reduction reactions therein are controlled by controlling the dew point of the atmosphere.

To accomplish closed loop control of such reactions in a furnace, the traditional approach has been to keep the $H_2$% in the furnace constant and to control the dew point by, for example, humidifying $N_2$ used in the process, i.e. by passing it through a bubbler or by injecting steam into the furnace. Closed-loop control of the $H_2O$ level in such atmospheres often gives poor results and practitioners have generally restricted themselves to monitoring the dew point in the furnace atmosphere and insuring that it is sufficiently constant, in relation to the $H_2$ level, so that a desired quality metallurgical process is achieved.

Prior art attempts at providing closed-loop control in these furnace atmospheres have not achieved effective results for the following reasons:

- Dew Point Control: Typically, a sample is pumped from the furnace atmosphere, cooled to a temperature above the water saturation point and the dewpoint is measured. Response times of various commercially available instruments is quite long, often many minutes. Response times are also often much longer for decreasing dewpoints, than for increasing dewpoints.
- Bubblers: A common method of setting an $H_2/H_2O$ ratio in a furnace operating with a $H_2/N_2$ atmosphere, is to humidify the $N_2$ by bubbling it through a water bath at a controlled temperature. Such systems take a long time to equilibrate and the dewpoint cannot readily be varied to respond to changing furnace conditions.
- The use of $O_2$ probes in heat treatment furnaces to control $O_2$ partial pressure ($pO_2$) in the furnace has been discussed in the literature. Most of the commercial applications have been limited to monitoring of the atmosphere and to a few heat $O_2$ probes in carburizing applications. Many problems are encountered in such applications, e.g.:
  - Carbon potential depends on absolute CO level as well as $O_2$ potential. A separate measurement of the CO level must be made in the furnace.
  - $CH_4$ is added as a carbon source. This results in erroneous readings at the probe since the Pt electrode acts as catalyst to reform the $CH_4$ to CO and $H_2$. Moreover response time of the probe suffers.
  - Soot formation at the probe also leads to erroneous readings.

In many annealing applications, the advantage of the inherently fast response time of $O_2$ probes is lost because typical annealing atmospheres (containing CO, $CO_2$, $H_2$ and $H_2O$) are not in equilibrium with respect to the water shift reaction.

Prior art directly related to the use of $O_2$ probes in heat treating furnaces, specifically annealing furnaces (as distinct from carburizing furnaces) are listed below. Dew point measurements are presently the most common method of monitoring and controlling annealing furnaces.

(1) Armson, F. J.; Barnett, J. H.; Davies, D. W. L. "Electrochemical Sensors for Heat Treatment Atmosphere Monitoring"; Met.-Slag-Gas React. Processes, [Pap.Int.Symp.] (1975), 905–18: This paper provides a general review of use of $O_2$ probes for monitoring heat treating atmospheres. Bright annealing and carburizing are discussed. No details are given on how to implement closed-loop control.

(2) Poor R. P., Huber M. J. and Barbee G. W., "Gas Analysis System for furnaces and the like", U.S. Pat. No. 5,211,820; this patent describes uses of $O_2$ probes in controlling annealing furnaces: specific advantages claimed are:

- possibility of use the $O_2$ probe to indicate whether the furnace is purged and it is safe to introduce combustibles such as $H_2$.
- varying the amount of scavenger gas ($H_2$) and inert gas ($N_2$) in order to minimize the amount of scavenger gas.

(3) Sastri P. and Abraham K. P., "Atmosphere Control in Heat Treatment Furnaces using Oxygen Probes," Tool and Alloy Steels, 155–62, April–May 1986: This article contains a general discussion on the subject topic. Decarburization annealing is mentioned, as is the use of $O_2$ probes to control generators. The article contains no discussion on implementation of closed-loop control in annealing furnaces.

(4) Chen Y. C., "Automatic Control of Carbon Potential in Furnace Atmospheres without Adding Enriched Gas," Metallurgical Transactions B, 24B, 881–8, October 1993: This paper discusses the generation of atmospheres with controlled carbon potential by passing mixtures of $N_2$ and $H_2O$ over hot charcoal. The carbon potential of the resulting atmosphere is controlled using $O_2$ probes. Both ON-OFF and PID loop control are discussed.

(5) Weissohn K. H., "Sauerstoffmesszellen zum Regeln von Ofenatmosphären" Gaswärme International, 32, 436–7, 1983: This article contains brief mention of use of $O_2$ probes to control decarburization annealing in exothermic atmospheres, based on $CO/CO_2$ ratios.

(6) Weissohn K. H., "Oxygen Partial Pressure Measurements with a Zirconium Oxide Probe," Gas Wärme International, 29, 331–42, 1980: This paper provides a general overview of the theory of $O_2$ probes as applied to heat treating furnaces. Oxidation-reduction diagrams are given for several metals.

(7) Japanese patent disclosures dealing with $O_2$ probes used for annealing are as follows: "Apparatus for Oxygen Analysis" JP 05-164727 A2 "Oxygen Sensor for Annealing" JP 56-107155 A2 "Annealing of Steels" JP 56-102518 A2 "Annealing of Steels" JP 56-013430

SUMMARY OF THE INVENTION

A closed-loop control system controls introduction of either water or hydrogen into a furnace region where a part is subjected to an elevated temperature to accomplish a heat treatment process. The heat treatment process causes the part to participate in reduction and/or oxidation reactions which remain in balance at the elevated temperature so long as a hydrogen/water ratio set point is maintained. The system includes an oxygen probe in communication with the furnace region for providing (i) an oxygen output indicative of sensed oxygen concentration within furnace region, and (ii) a temperature output indicative of temperature therein. A controller determines from the oxygen output and temperature output, a measured ratio of hydrogen to water within the furnace region and compares the measured ratio with the hydrogen/water ratio set point, and provides a correction signal output in accordance with a determined difference between the measured ratio and the ratio set point. A flow controller is responsive to the correction signal output to provide a flow of at least one of hydrogen and water to the furnace region to move the hydrogen/water ratio towards said ratio set point.

DETAILED DESCRIPTION OF THE PREFERRED EMBODIMENT

A closed-loop control system uses $O_2$ probes in a $H_2/N_2$ furnace atmosphere, above 600° C. The only relevant equilibrium is:

$$H_2+\tfrac{1}{2}O_2=H_2O \tag{1}$$

Reaction (1) is very fast above 600° C. and is always in equilibrium. This makes possible dynamic control of oxidation/reduction reactions in such atmospheres.

The invention applies to heat treating processes where the quantity to be controlled in the furnace is the $H_2/H_2O$ ratio. For instance, in decarburization annealing, carbon is extracted from the steel via oxidation, but the atmosphere has to stay reducing for iron and possibly other metallic alloying elements present in the steel, i.e.:

$$C_{(steel)}+H_2O=CO+H_2 \tag{2}$$

$$Fe+H_2O=FeO+H_2 \tag{3}$$

$$M_{(steel)}+H_2O=MO+H_2 \tag{4}$$

M refers to alloying elements in the steel such as Si, Cr, etc. The atmosphere should be oxidizing with respect to expression (2) but reducing with respect to expressions (3) and (4). The equilibrium for all these reactions is controlled by the $H_2/H_2O$ ratio. Moreover, it has been found that the rate of decarburization (expression 2) is proportional to the absolute $H_2O$ content of the atmosphere. For highest decarburization rates, the atmosphere should be controlled to the lowest $H_2/H_2O$ ratio that is compatible with keeping expressions (3) and (4) in the reducing range.

Figure 1:
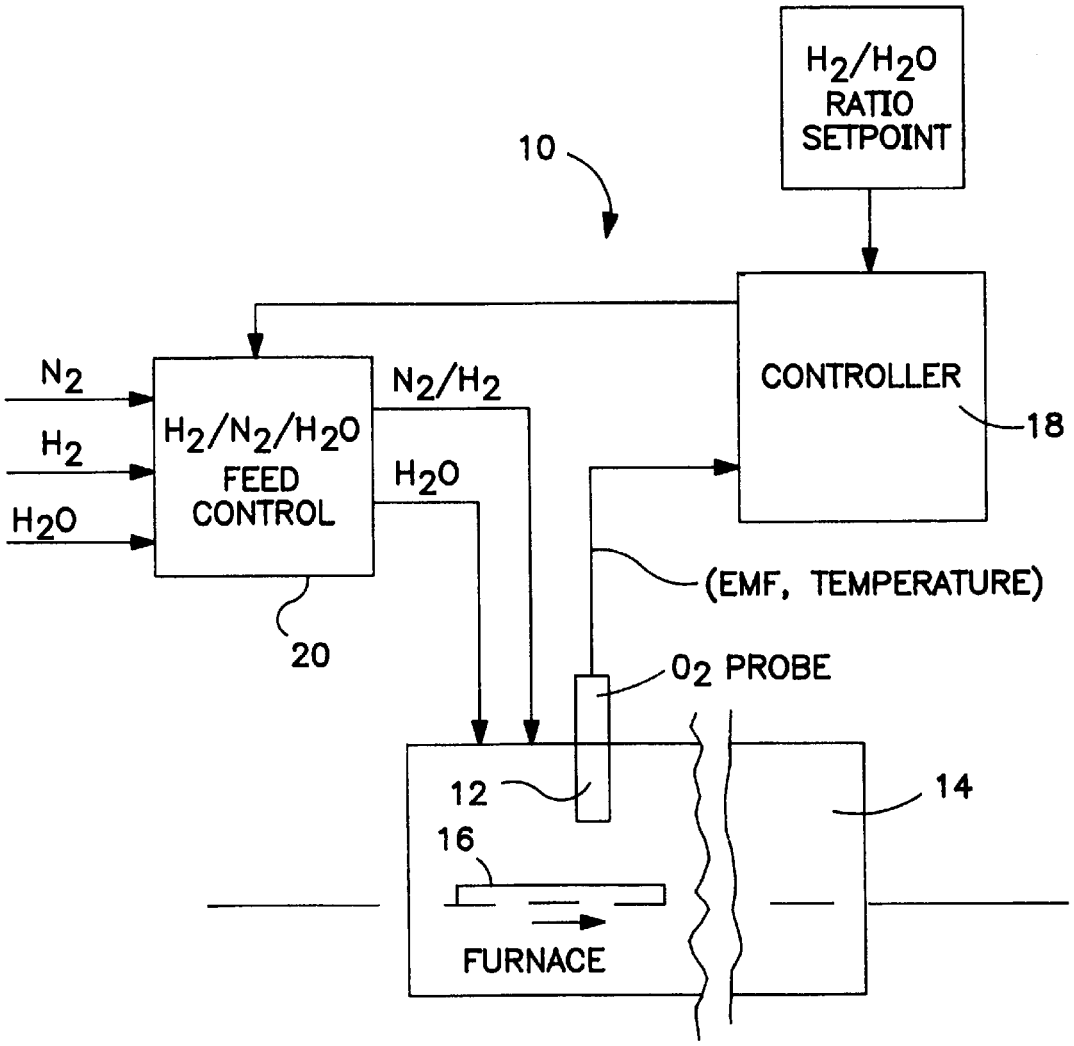
FIG. 1 is a block diagram of a closed loop control system embodying the invention.

In FIG. 1, a desired $H_2/H_2O$ ratio setpoint is input to a control loop 10. An in-situ $O_2$ probe 12 in a furnace 14 is positioned in close proximity to parts 16 to be treated. $O_2$ probe 12 generates an EMF and a temperature signal to a controller 18. Using these signals, controller 18 calculates the effective $H_2/H_2O$ ratio in real time at the monitored location in furnace 14, using thermodynamic formulae. Based on any observed deviation from the setpoint, controller 18 sends a proportional signal to an actuator in an $N_2/H_2/H_2O$ feed control panel 20, either to change the amount of $H_2$ being injected into furnace 14 or to change the amount of $H_2O$ (steam) being injected into furnace 14.

It has been found that for effective operation, the location is important for the injection point of the control gas ($H_2$ or $H_2O$) with respect to the $O_2$ probe location, workpiece location and atmosphere flow direction. These parameters will be explained in more detail in the examples below.

As shown in FIG. 1, the cell voltage and temperature signal from $O_2$ probe 12 is converted to a $H_2/H_2O$ ratio, using thermodynamic calculations which are carried out in real time in controller 18. The measured $H_2/H_2O$ ratio is compared with the setpoint value in controller 18 which sends an appropriate correction signal to $H_2/N_2/H_2O$ feed control panel 20 to make adjustments to either the amount of injected steam or $H_2$.

The invention will further be described using two heat-treating examples: decarburization annealing of silicon steel and bright annealing of transformer laminations, both in continuous roller hearth furnaces.

Process Theory

Oxygen probes are constructed by placing a fully or partially stabilized zirconia material between two atmosphere chambers, each containing a platinum electrode. At temperature (>600° C.), with the two chambers containing gases of different oxygen concentrations, an electrolytic cell is established and a voltage (EMF) between the two electrodes (due to oxygen ion conductivity) can be measured. The cell voltage has been shown to follow the fundamental equation for electrolytic cells (Nernst equation):

$$E=0.0215\times T\times\log_e(pO_{2reference}/pO_{2sampLe}) \tag{5}$$

where:

E=Cell output EMF (mV)

T=Cell Temperature (°K.)

$pO_{2reference}$=reference oxygen pressure (atm.)

$pO_{2sample}$=sample oxygen pressure (atm.)

If the temperature and $pO_2$ are accurately known, then the cell output is a linear function of the logarithm of the sample $pO_2$. The probe does not have to be calibrated and there are no calibration constants in the equation.

With air used as reference gas, $pO_{2reference}$=2095. Using this constant and substituting log(base ten) for the natural logarithm, the Nernst equation can be rearranged and solved for $\log_{10}(pO_{2sample})$:

$$\mathrm{Log}_{10}(pO_{2sample})=-0.06788-20.20\times E/T \tag{6}$$

$$pO_{2sample}=10^{(-0.06788-20.20*E/T)} \tag{7}$$

The equilibrium $pO_2$ can be related to the $H_2/H_2O$ ratio. As mentioned, above 600° C., $H_2$, $H_2O$ and $O_2$ are in equilibrium according to expression (1). The equilibrium constant $K_1$ is then:

$$K_1=pH_2O/(pH_2*pO_2^{1/2}) \tag{8}$$

This equilibrium constant can be calculated from the known heat of formation of water (FE):

$$K_1=\exp[-FE/(1.987*T)] \tag{9}$$

where:

$$FE=a=b*\log_{10}(T)+c*T^2+d/T+e*T \quad (10)$$

where:

a=−56,930 b=+6.75 c=0.00064 d=−8,000 e=−8.74

Equation (8) can be solved for $PO_2$ as follows:

$$PO_2=[1/(K_1*R)]^2 \quad (11)$$

where: $R=pH_2/pH_2O$

Since $K_1$ is only a function of temperature, the output EMF value of the probe and the temperature at the probe location uniquely determine the value of the $H_2/H_2O$ ratio.

Decarburization Annealing

Silicon steel sheets for magnetic applications such as cores for electrical motors and transformers, are heat treated to remove the residual carbon to very low levels in order to increase permeability and reduce magnetic losses. Since these sheets run at 100 to 200 fpm through the furnace, limited time is available for the carbon extraction. Optimization of the atmosphere to allow maximum carbon removal rates is therefore critical. As mentioned earlier, the rate of carbon removal is proportional to the absolute amount of water in the atmosphere; however, in order to avoid internal oxidation, the $H_2/H_2O$ ratio must be higher than 3. Since carbon removed from the steel continuously reacts with $H_2O$ from the atmosphere and adds H2 (see reaction 2), it is important to measure the $H_2/H_2O$ ratio along the furnace length and to inject steam at multiple points along the decarburization zone.

When the steel sheet enters the furnace, it is heated to the decarburization temperature (1650° F.) in succeeding preheat zones. The steel sheet then enters a decarburization zone and is soaked in a dry $H_2/N_2$ atmosphere and cooled in two succeeding cooling zones (slow and fast). The general atmosphere flow is arranged so that it flows from the furnace exit toward the furnace entrance. This flow pattern is essential in order to establish a tight coupling between steam injection and measured $H_2/H_2O$ ratio along the furnace length. This flow pattern also allows a $H_2$ and $H_2O$ concentration profile to be established in the furnace.

Figure 2:
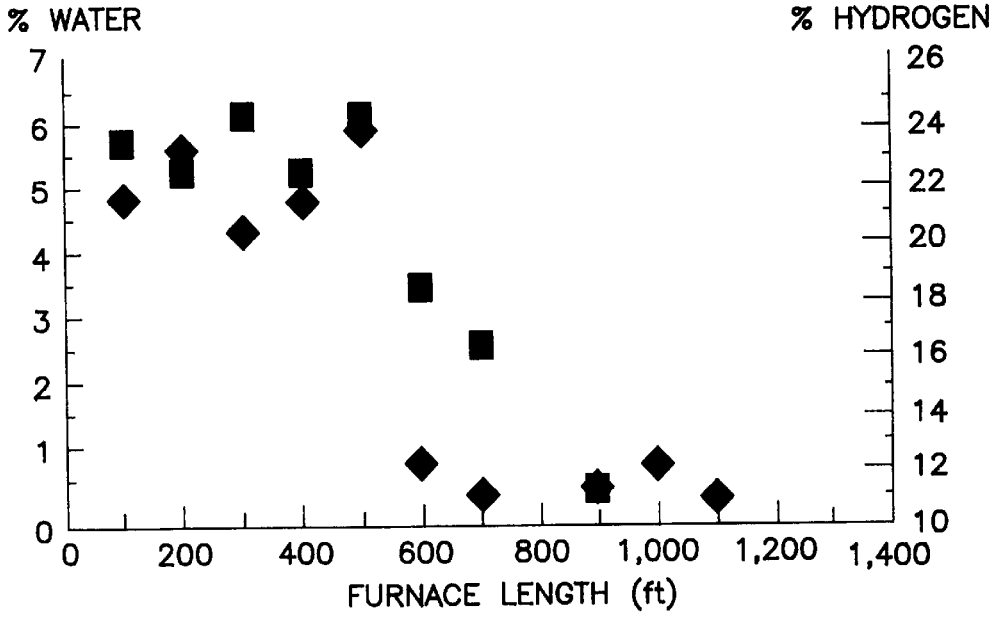
FIG. 2 is a plot of hydrogen and water % concentrations versus location in an anneal furnace.

A prior art system employs ten dewpoint measuring devices. In order to measure the dewpoints, atmosphere samples are pumped out of the furnace and cooled to a temperature slightly above the maximum dewpoint to be encountered. Steam is injected in four locations. FIG. 2 is a plot showing water % (dewpoint) and hydrogen as measured at various points in the prior art furnace.

Figure 3:
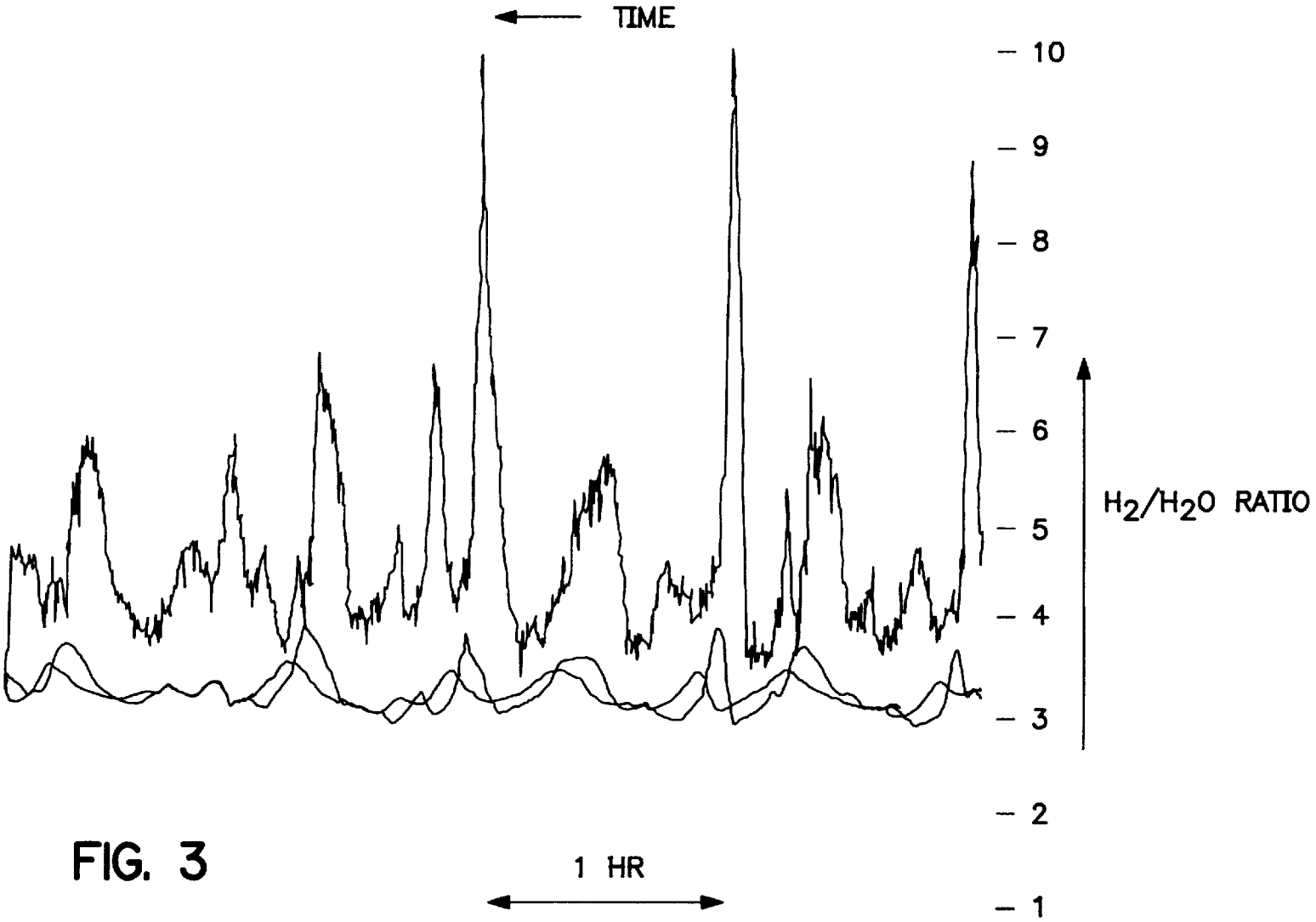
FIG. 3 is a plot of $H_2/H_2O$ ratio versus time, when a dew point based control system is used.

Closed loop control in the prior art system was established using the dew point measurements. Control was found to be erratic and the line needed to be slowed down often to meet required magnetic properties. FIG. 3 is a plot of the $H_2/H_2O$ ratio achieved.

The prior art dewpoint sensors were replaced with four $O_2$ probes located at disparate positions. The probe tips were located about 1 ft. above the strip surface. An $O_2$ probe, positioned after the decarburization zone, served as a control to monitor whether the $H_2/H_2O$ ratio was sufficiently high in the soaking region (>20).

A series of tests were performed using the $O_2$ probes as monitoring devices while the furnace was controlled by the dew-point devices. The dewpoint controllers indicated satisfactory control with dewpoints of 90° F.±5° F. However, as shown in FIG. 3, the $H_2/H_2O$ ratios, as measured by the $O_2$ probes, showed significant variations. $O_2$ probe #3 which is most critical since it monitors the location where steam is first injected, showed very large fluctuations (ratios between 3 and 10), indicating poor control due to time lags in the measuring devices.

Figure 4:
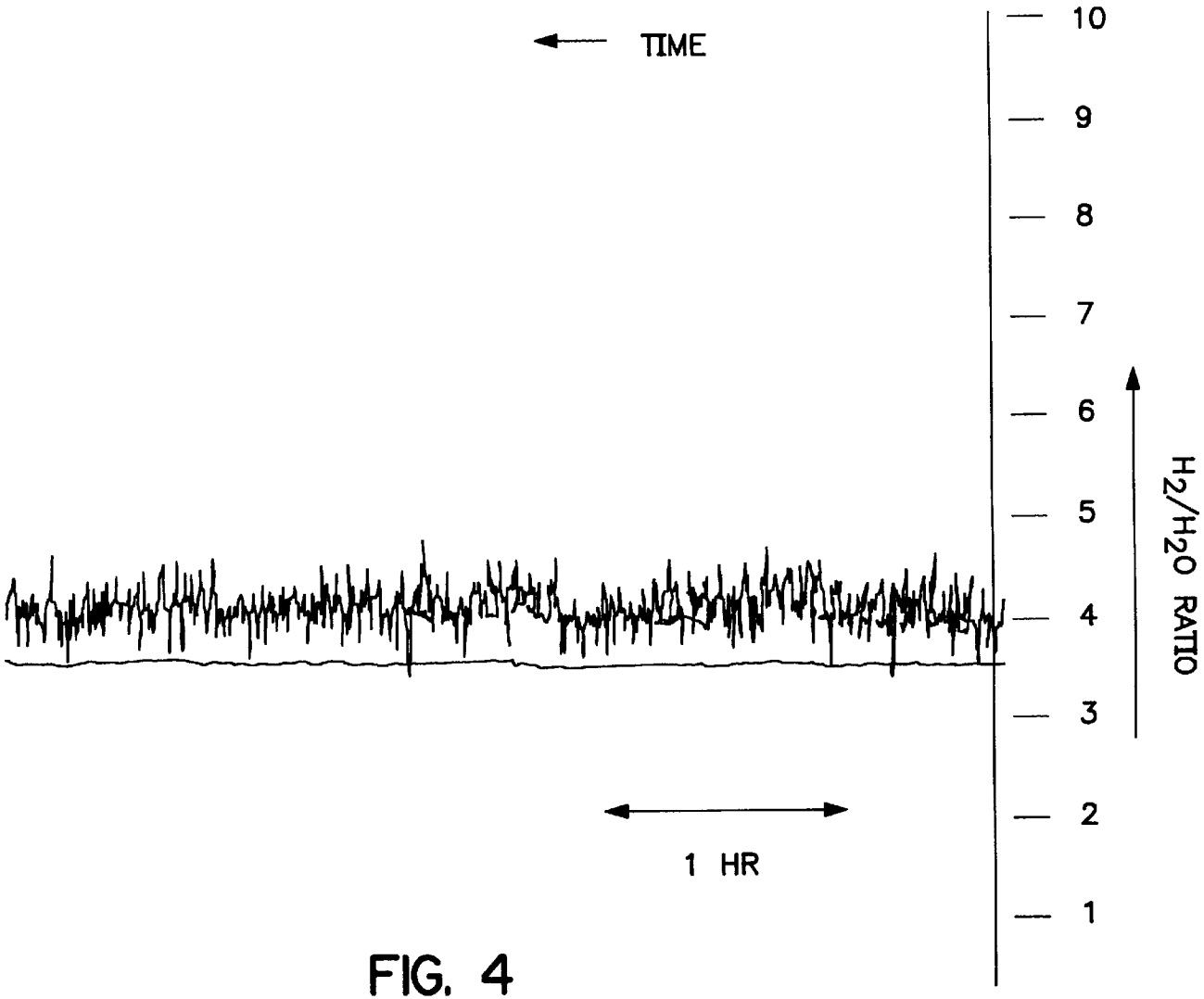
FIG. 4 is a plot of $H_2/H_2O$ ratio versus time, when an oxygen probe-based control system is used.

The furnace was then switched to control by the $O_2$ probes, keeping only three steam ports active. After tuning the control loops, the achieved $H_2/H_2O$ ratios (as a function of time) are shown in FIG. 4. The setpoint for the $H_2/H_2O$ ratio for probes #3 and #4 was set at 4. The control was excellent. It was, however, observed that the readings of probe #3 were much noisier than the other probes. Since this probe controls the first steam injection point which is only about 60' upstream from the probe, it was surmised that the signal fluctuations were due to incomplete mixing of the $H_2O$ with the $H_2/N_2$ atmosphere. A new steam injection sparger was designed (high pressure) to promote mixing and resulted in a complete elimination of the fluctuations in probe #3. This example illustrates the superior control achieved through the use of the $O_2$ probe to optimize the location and the method of injection of the controlling gas.

The $O_2$ probes are commercial units sold by Barber-Colman. In addition to the excellent atmosphere control capability using control loop technology, the availability of a microprocessor allows the following features to be built in at little extra cost:

- Furnace startup: The $O_2$ probes can be used to determine when the furnace is inerted. According to NFPA guidelines, combustibles cannot be introduced unless furnace is above 1400° F. or if it is determined that $O_2$ level is below 1%. The use of $O_2$ probes enables the second method to be used, resulting in quicker startup since desired atmosphere composition can be reached more quickly.
- The performance of the probe can be monitored by measuring its internal resistance. If the internal resistance drops to less than half its initial value, the probe needs to be replaced. An alarm to alert to a need for probe replacement can be built in.
- High/low alarms on the $H_2/H_2O$ ratio.
- All signals are available for transmission to a data acquisition system.

Bright Annealing

Another advantage of the improved $H_2/H_2O$ ratio control is that the amount of $H_2$ injected into the furnace can be more closely controlled, resulting in significant $H_2$ savings. For example, if Fe oxidation is to be avoided, it is possible with better control to operate more closely to the redox line for Fe than previously possible. For example, for bright annealing at 800° C., the minimum $H_2/H_2O$ ratio to avoid oxidation is about 2; however, because unavoidable air inleaks into the furnace and poor control, it is usually necessary to increase this ratio to 8 or higher.

Using closed loop control with $H_2$ injection to immediately maintain a set ratio when air inleaks or other disturbances take place, it is often possible to significantly reduce the $H_2$ consumption.

Such a system was implemented in a roller hearth furnace used for bright annealing of transformer cores. The $O_2$ probe (Barber Colman) was mounted in the roof of the furnace hot zone. A controller similar to the one used for decarburization annealing was used (with only a one probe control loop). An $H_2/H_2O$ ratio setpoint was compared with a ratio measured in the furnace. Additional $H_2$ was injected in the hot zone when the ratio dropped below the setpoint.

From the above experimental evidence, it is clear that the control scheme of the invention can be applied to all heat treating processes using an $H_2/N_2$ atmosphere, where the $H_2/H_2O$ ratio must be controlled within narrow limits. The principal advantage of using in-situ $O_2$ probes to control furnace atmospheres lies in the fact that they can measure the relevant process parameter (the $O_2$ potential or $H_2/H_2O$ ratio) directly and with very short time delay in the vicinity of the parts to be treated. This allows the location and method of injection of the controlling gas ($H_2$ or $H_2O$) to be arranged so that effective dynamic control of the workpiece/atmosphere interaction is achieved. Its essential features are:

The controlling reaction is the $H_2$–$H_2O$ reaction (expression 1) which is in fast equilibrium above 600° C.

The injected control gas ($H_2$ or steam) must change the $H_2/H_2O$ ratio immediately.

The location and method of control gas injection in relation to the probe location is important so that the atmosphere near the probe is well mixed and representative of the effect of the control gas admixture.

The probes are located in proximity to the workpieces.

Examples of other processes where this invention can be applied are:

Iron Powder Reduction

Debinding and sintering of ceramic and metal powders in $H_2/N_2$ atmospheres.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. Apparatus for controlling introduction of either water or hydrogen into a furnace region where a part is subjected to an elevated temperature to accomplish a heat treatment process, said heat treatment process causing said part to cooperate in reduction and/or oxidation reactions which remain in balance at said elevated temperature so long as a hydrogen/water ratio set point is maintained, said apparatus comprising:

oxygen probe means in communication with said furnace region for providing an oxygen output indicative of sensed oxygen concentration within said furnace region and a temperature output indicative of temperature therein;

controller means for determining from said oxygen output and temperature output, a measured ratio of hydrogen/water within said furnace region, for comparing said measured ratio with said hydrogen/water ratio set point, and for providing a correction signal output in accordance with a determined difference between said measured ratio and said ratio set point; and flow control means responsive to said correction signal output for providing a flow of at least one of hydrogen and water to said furnace region to move said hydrogen/water ratio towards said ratio set point.

2. Apparatus as recited in claim 1, wherein said oxygen probe means senses oxygen and temperature solely from an area within said furnace region that is juxtaposed to said part.

3. Apparatus as recited in claim 1, wherein said flow control means injects water into said furnace region in an area therein that is juxtaposed to said oxygen probe means.

4. Apparatus as recited in claim 1, wherein said flow control means injects hydrogen into said furnace region in an area therein that is juxtaposed to said oxygen probe means.

5. Apparatus as recited in claim 1, wherein said part is steel and said heat treatment process is a decarburization annealing process.

6. Apparatus as recited in claim 1, wherein said part is a steel transformer lamination and said heat treatment process is a bright annealing process.

7. Apparatus as recited in claim 1, wherein said controller means determines said measured hydrogen/water ratio by use of the following expressions:

$$K_1 = pH_2O/(pH_2 \cdot pO_2^{0.5})$$

$$K_1 = \exp(-FE/(1.987 \cdot T))$$

$$FE = a + b \cdot \log_{10}(T) + c \cdot T^2 + d/T + e \cdot T$$

where:

a=−56,930 b=+6.75 c=−0.00064 d=−8,000 e=−8.74

$$pO_2 = (1/(K_1 \cdot R))^2$$

where $R = pH_2/pH_2O$.

8. A method for controlling introduction of either water or hydrogen into a furnace region where a part is subjected to an elevated temperature to accomplish a heat treatment process, said heat treatment process causing said part to cooperate in reduction and/or oxidation reactions which remain in balance at said elevated temperature so long as a hydrogen/water ratio set point is maintained, said furnace region having an oxygen probe inserted thereinto, said method comprising the steps of:

deriving an oxygen output from said oxygen probe that is indicative of sensed oxygen concentration within said furnace region and a temperature output indicative of temperature therein;

determining from said oxygen output and temperature output, a measured ratio of hydrogen/water within said furnace region;

comparing said measured ratio with said hydrogen/water ratio set point and providing a correction signal in accordance with a determined difference between said measured ratio and said ratio set point; and responding to said correction signal output by providing a flow of at least one of hydrogen and water to said furnace region to move said hydrogen/water ratio towards said ratio set point.

9. The method as recited in claim 8, further comprising the step of:

positioning said oxygen probe to sense oxygen and temperature solely from an area within said furnace region that is juxtaposed to said part.

10. The method as recited in claim 9, wherein said determining step derives said measured hydrogen/water ratio by use of the following expressions:

$$K_1 = pH_2O/(pH_2 \cdot pO_2^{0.5})$$

$$K_1=\exp(-FE/(1.987\cdot T))$$

$$FE=a+b\cdot\log_{10}(T)+c\cdot T^2+d/T+e\cdot T$$

where:

a=−56,930 b=+6.75 c=−0.00064 d=−8,000 e=−8.74

$$pO_2=(1/(K_1\cdot R))^2$$

where $R=pH_2/pH_2O$.

11. Apparatus for controlling introduction of either water or hydrogen into a furnace region where a part is subjected to an elevated temperature to accomplish a heat treatment process, said heat treatment process causing said part to cooperate in reduction and/or oxidation reactions which remain in balance at said elevated temperature so long as a hydrogen/water ratio set point is maintained, said apparatus comprising:

(a) oxygen probe means in communication with said furnace region for providing an oxygen output indicative of sensed oxygen concentration within said furnace region and a temperature output indicative of temperature therein;

(b) controller means for determining from said oxygen output and temperature output, a measured ratio of hydrogen/water within said furnace region, for comparing said measured ratio with said hydrogen/water ratio set point, and for providing a correction signal output in accordance with a determined difference between said measured ratio and said ratio set point, said hydrogen/water ratio determined using the following expressions:

$$K_1=pH_2O/(pH_2\cdot pO_2^{0.5})$$

$$K_1=\exp(-FE/(1.987\cdot T))$$

$$FE=a+b\cdot\log_{10}(T)+c\cdot T^2+d/T+e\cdot T$$

where a, b, c, d and e are constants;

$$pO_2=(1/(K_1\cdot R))^2$$

where $R=pH_2/pH_2O$, flow control means responsive to said correction signal output for providing a flow of at least one of hydrogen and water to said furnace region to move said hydrogen/water ratio towards said ratio set point.

12. A method for controlling introduction of either water or hydrogen into a furnace region where a part is subjected to an elevated temperature to accomplish a heat treatment process, said heat treatment process causing said part to cooperate in reduction and/or oxidation reactions which remain in balance at said elevated temperature so long as a hydrogen/water ratio set point is maintained, said furnace region having an oxygen probe inserted thereinto, said method comprising the steps of:

(a) deriving an oxygen output from said oxygen probe that is indicative of sensed oxygen concentration within said furnace region and a temperature output indicative of temperature therein;

(b) determining from said oxygen output and temperature output, a measured ratio of hydrgen/water within said furnace region using the following expressions:

$$K_1=pH_2O/(pH_2\cdot pO_2^{0.5})$$

$$K_1=\exp(-FE/(1.987\cdot T))$$

$$FE=a+b\cdot\log_{10}(_{i\ T})+c\cdot T^2+d/T+e\cdot T$$

where a, b, c, d and e are constants;

$$pO_2=(1/(K_1\cdot R))^2$$

where $R=pH_2/pH_2O$, (c) comparing said measured ratio with said hydrogen/water ratio set point and providing a correction signal in accordance with a determined difference between said measured ratio and said ratio set point;

(d) responding to said correction signal output by providing a flow of at least one of hydrogen point; and (e) positioning said oxygen probe to sense oxygen and temperature solely from an area within said furnace region that is juxtaposed to said part.

* * * * *